US005367738A

United States Patent [19]

Junger

[11] Patent Number: 5,367,738

[45] Date of Patent: Nov. 29, 1994

[54] DEVICE FOR CLEANING ROWS OF MACHINES

[75] Inventor: Reiner Junger, Friedberg, Germany

[73] Assignee: Ernst Jacobi GmbH, Germany

[21] Appl. No.: 18,512

[22] Filed: Feb. 17, 1993

[30] Foreign Application Priority Data

Apr. 21, 1992 [DE] Germany ..... 4213120

[51] Int. Cl.[5] ..... A47L 5/14

[52] U.S. Cl. ..... 15/312.2; 15/316.1; 15/330; 15/331

[58] Field of Search ..... 15/312.1, 312.2, 316.1, 15/331, 330

[56] References Cited

U.S. PATENT DOCUMENTS

| | | | |
|---|---|---|---|
| 3,276,065 | 10/1966 | King et al. | 15/312.2 |
| 3,375,539 | 4/1968 | Loepsinger | 15/312.1 |
| 4,891,860 | 1/1990 | Steinike | 15/312.2 |

*Primary Examiner*—Chris K. Moore
*Attorney, Agent, or Firm*—Pascal & Associates

[57] ABSTRACT

A device for cleaning rows of machines, such as textile machines, which can travel along the machines and has a blower guided above the machines, whose pressure side is connected to a distributor station. At least two hoses are attached via connecting pieces to the distributor station which have different openings directed to the machines. A slider is located on the distributor station which distributes the air supplied to the distributor station in accordance with its position on the connecting pieces. A number of hoses can be attached to the device, and the hose to be charged with air can be easily selected by a slider which can travel along the row of connecting pieces. The slider has a through-hole which, when the slider is moved, successively coincides with the connecting pieces. A flexible hose which leads to the pressure side of the blower and surrounds the through-hole, is attached to the side of the slider facing away from the connecting pieces. In another embodiments, the connecting pieces are arranged in a straight or in a curved row. In another embodiment, the flexible hose is fastened, with its side facing the pressure side of the blower, to a further slider whereby by operating the slider, the flexible hose can be connected with the suction side of the blower.

12 Claims, 2 Drawing Sheets

DEVICE FOR CLEANING ROWS OF MACHINES

FIELD OF THE INVENTION

The invention relates to a travelling device for cleaning rows of textile machines.

BACKGROUND TO THE INVENTION

In a textile processing plant, various types of textile machines are usually arranged in a row. In a spinning mill, these are for example spinning or washing machines. To clean these machines, they have to be blown out at various points. For example, to clean the whorl valve of a spinning machine, a blast of air current must be directed to the whorl valve by means of a nozzle.

In order to be able to blow out the various machines at different points, it is known from German Patent No. 34 25 545 to direct two hoses from a distributor station which have different openings to the machines. These two hoses are located on two horizontally extending connecting pieces on the distributor station and are guided vertically downward along a curve of 90°. A flat air-conducting element, which is swivelable about a horizontal axis and seals either the one or the other connection orifice is located in the distributor box.

The device has the disadvantage that as one of the two hoses is always acted upon by compressed air, it is not possible to separate the two hoses from the compressed air source. Furthermore, only two compressed air hoses can be connected to the distributor station.

German Patent Publication GM 85 08 228 describes a cleaning device which can travel along the textile machines, having a ventilator on which at least two hoses are located as well as a distributor box for distributing the blast-air to the two hoses. Within the distributor box, there is a valve with a horizontal swivel axis which leads the blast of air to one of several blast hoses attached to the distributor box. One of the blast hoses is used to blow on a washing machine, the other to blow on a spinning machine and a further blast hose is provided for blowing out the whorl valve of a spinning machine.

A disadvantage of this device is that the distributor box must be constructed quite high due to the arrangement of the valves. Moreover, the number of hoses to be charged with air is limited to three. Finally, there is no position in which none of the hoses is charged with air.

German Patent DE 36 18 934 A1 describes a device for cleaning textile machines having blowers guided above the textile machines, to whose pressure side two vertically extending blast hoses, which have different openings directed to the machine, are attached via a distributor box. In the distributor box, there is an air-conducting element which conveys the blast air to one or the other blast hose. This air-conducting element is a flat baffle which is located inside the distributor box above the connection openings to which the blast hoses are attached. In one position of this baffle, the one connection is covered and, in the other position, the other connection is covered. As a result, the air-blast hose located at the connection which is covered in each case is shut down.

This arrangement does enable the simultaneous sealing of all blast-air hoses, however, only if they are not too numerous. With more than three blast-air hoses, the arrangement can no longer be used. Moreover, the air-conducting baffle must be moved electromotively, as it is not manually accessible inside the distributor box.

SUMMARY OF THE INVENTION

An object of the present invention is to further develop a device for cleaning textile machines such that a number of hoses can be attached thereto and that the hose to be charged with air can be easily selected.

In accordance with the present invention, a device for cleaning rows of machines which can travel along the machines is comprised of a blower guided above the machines, a pressure side of the blower being connected to a first distributor station, at least two hoses attached to the distributor station via connecting pieces which have different openings directed toward the machines, a first slider being located on the distributor station which distributes air supplied to the distributor station according to its position on the connecting piece, the slider being moveable moved along the row of connecting pieces and having a through-hole which, when the slider is moved, successively coincides with the connecting pieces, the slider being attached to a flexible hose which is attached to the pressure side of the blower, the flexible hose surrounding the through-hole on the side of the slider facing away from the connecting pieces.

BRIEF INTRODUCTION TO THE DRAWINGS

An embodiment of the invention shall be described below with reference to the drawings, in which the same parts are designated with the same reference numbers, and in which.

DETAILED DESCRIPTION OF THE INVENTION

The device essentially is comprised of a blower 1, a distributor station 2 and a flexible hose 3 connecting the blower 1 with the distributor station 2.

Figure 1:
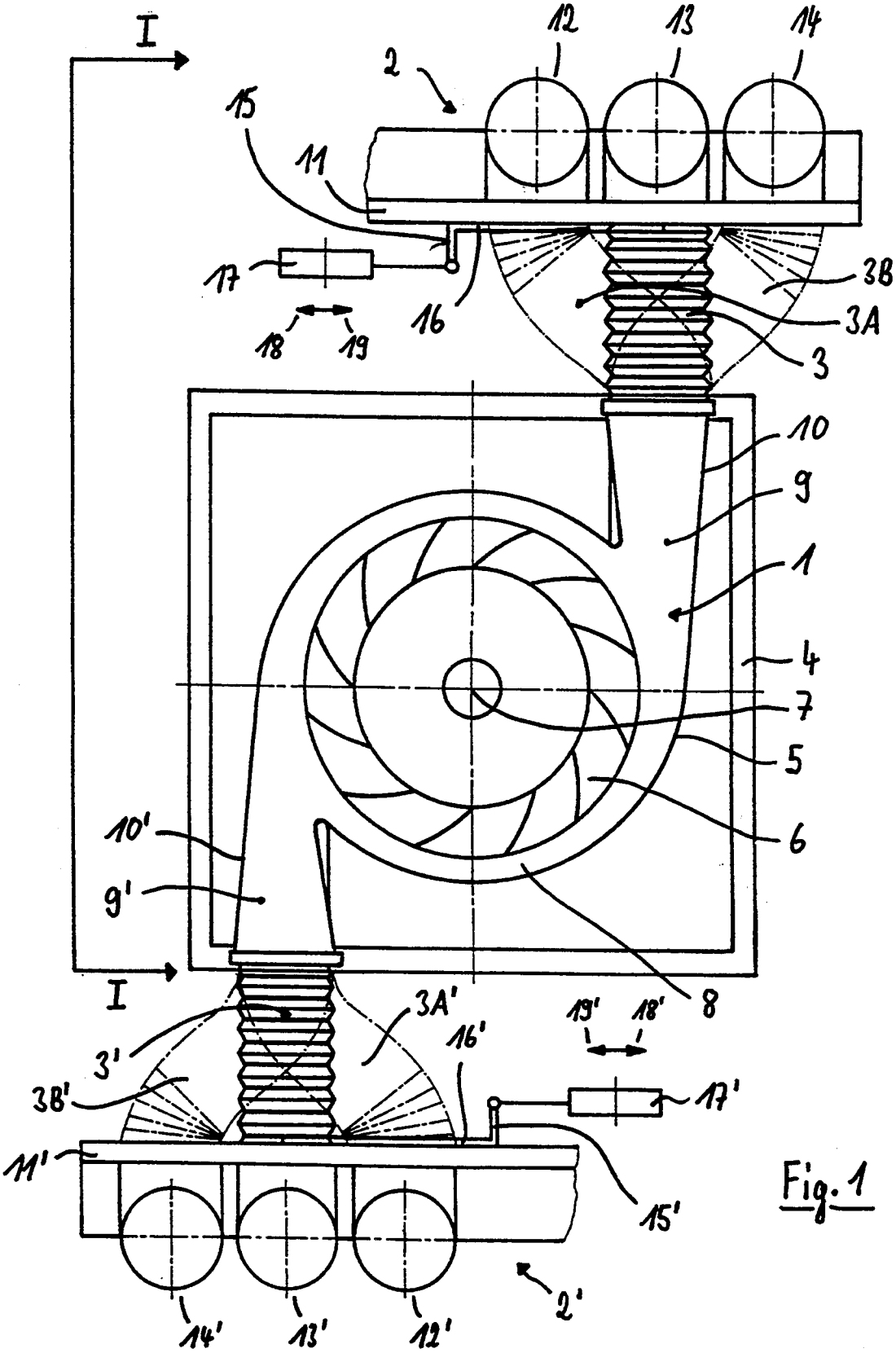
FIG. 1 is a horizontal section through a part of the device containing the blower and two distributor stations.

The blower 1 has an outer housing 4 in which a ventilator housing 5 is situated. The ventilator housing 5 contains an impeller 6 which is mounted centrally in the ventilator housing 5 and rotates about an axis 7 extending vertically to the drawing plane of FIG. 1. The wall of the ventilator housing extends over a wide area 8 at a constant distance from the periphery of the impeller 6. This distance increases continuously in the area of the air outlet 9, the inside wall 10 of which extends from the wall of the ventilator housing 5. The air duct 9 ends in the wall of the outer housing 4. A flexible hose 3, which extends the air duct 9 outward, is attached to the air duct 9 at this point. The flexible hose 3 connects the blower 1 with the distributor station 2.

The distributor station 2 has a carrier plate 11, three connecting pieces 12, 13 and 14 and a slider 16 provided with a handle 15. An electric control 17 is located on the handle 15 of the slider 16. Air-blast hoses for cleaning the machine parts are attached to the connecting pieces 12, 13 and 14.

In the illustrated embodiment, there is a further distributor station 2' having radial symmetry to the axis of rotation 7 of the impeller 6. The components of this second distributor station 2', that is the carrier plate 11', the three connecting pieces 12', 13' and 14', the slider 16' with the handle 15' and the electric control 17' are identical to the components of the distributor station 2 provided with the same reference numbers, however, without the apostrophe. The elements of the blower 1 allocated to the second distributor station 2' are also provided with reference numbers having an apostrophe.

The arrangement of a second distributor station 2' is advantageous when the blower 1 is located above the row of machines, where the axis 7 of the impeller 6 runs vertically. In this case, one side of the machine row can be cleaned with the hoses attached to distributor station 2 and the other side with the hoses attached to the distributor station 2'.

The construction and operation of the distributor station 2 is also the same for distributor station 2'.

The carrier plate 11 of the distributor station 2 supports the three connecting pieces (air conducting connectors) 12, 13 and 14 each in a through-hole. Slider 16 is supported on the other side of the carrier plate 11 and can be moved in the direction of the linear row of the through-holes supporting the connection pieces 12, 13 and 14. The slider 16 also has a through-hole which successively coincides with the three through-holes of the carrier plate 11 when the slider is moved. The flexible hose 3, which connects the slider 16 with the air duct 9 of the blower 1, is attached to the side of the slider 16 facing away from the carrier plate 11 in such a way that it seals and is connected with the through-hole of slider 16.

The device operates as follows:

The impeller 6 of blower 1, rotating counterclockwise about axis 7, conveys air from a plane below the drawing plane in the area of the impeller 6 which then flows into the air duct 10. After leaving the air duct 10, the air flows through the flexible hose 3 and reaches one of the connecting pieces 12, 13 and 14 via the bore of the slider 16 and one of the through-holes of the carrier plate 11. The position of the slider 16 shown in FIG. 1 connects the flexible hose 3 with the connecting piece 13. If the hose 3 is to be connected with connection piece 12, then slider 16 must be moved in direction of the arrow 18, which can take place either manually be operating the handle 15 or electromotively by operating the electric drive unit 17. In this case, the flexible hose 3 reaches the position 3A, which is shown by a broken line in FIG. 1, and is connected with connecting piece 12. If one wishes to connect the flexible hose 3 with connecting piece 14, then slider 16 is moved in a similar manner in direction of arrow 19.

Almost as many additional connecting pieces as desired can be realized in addition to the three illustrated connecting pieces 12, 13 and 14. In addition to the connection of the flexible hose 3 with one of the connection pieces 12, 13 and 14, the slider 16 can also be brought into a position in which the flexible hose 3 is not connected with any of the through-holes in the carrier plate 11, but is instead sealed by the carrier plate 11. In this position of the slider 16, no air is conveyed and the hoses attached to the connecting pieces 12, 13 and 14 can be replaced or cleaned.

In a alternative embodiment, the slider is made so large that it covers the through-holes not acted upon by compressed air at that moment, in order to prevent the fuzz found in the spinning mill from settling in the corresponding hoses.

Similarly, in another alternative embodiment, it is not necessary to arrange the through-holes of the carrier plate 11 in a straight row. These through-holes can also have another arrangement, for example, in a circle. In this case, the slider and its mounting must be adapted to the geometry.

Figure 2:
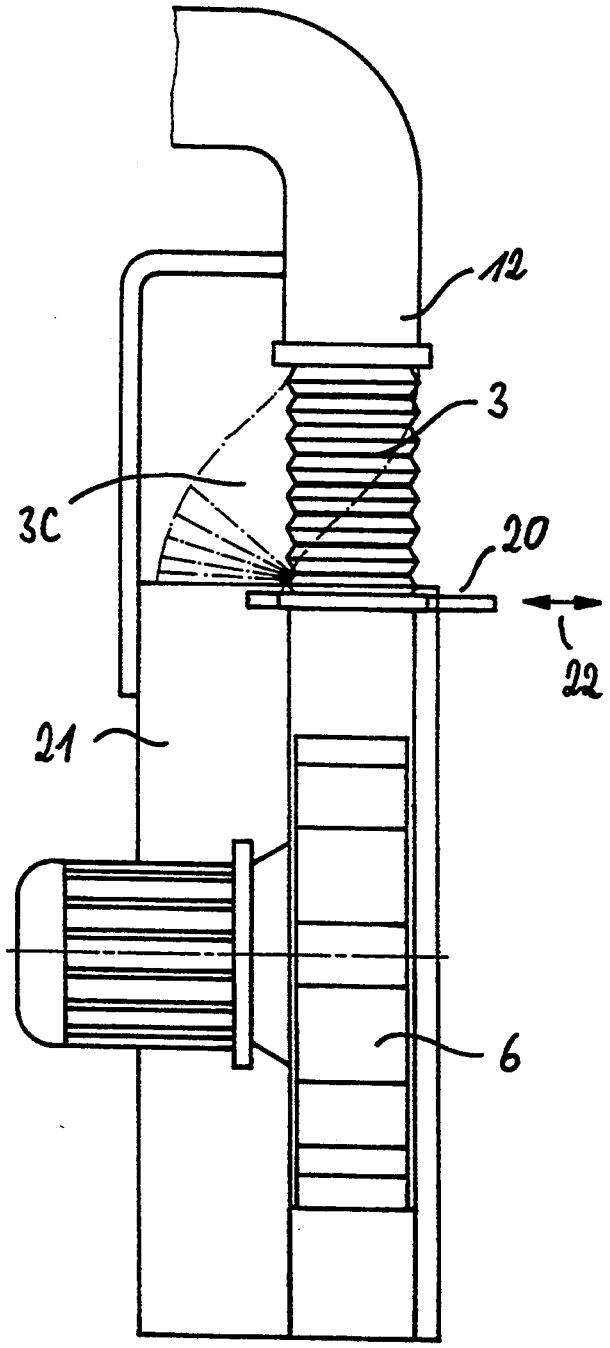
FIG. 2 is a partial sectional view, along the line I—I of FIG. 1, of an alternative embodiment of the invention.

A further improvement of the device is schematically illustrated in FIG. 2. If one wishes to charge the hoses attached to the connecting pieces 12, 13 and 14 with a negative pressure, that is, if air is to be drawn in through these hoses, the flexible hose 3 is fastened, on its side facing the pressure side of the blower 1, that is, at the transition from air duct 9 to the flexible hose 3, to a further slider 20, so that when this slider is operated, the flexible hose 3 can be connected to the suction side of the blower 21. The slider 20 shown in FIG. 2 can be moved along the double arrow 22, the suction position being shown by a broken line.

When the device is actually in service, it can be advantageous to, for example, supply the left side of the row of machines with compressed air and the right side with suction air. When the hose openings are made appropriately, the fuzz blown off from the machine parts is then conveyed to the suction openings and can be filtered out.

All of the above described embodiments of the present invention relate to their use in cleaning rows of textile machines. However, it is noted that the device of the invention is also suitable for cleaning other rows of machines in which similar pollution problems occur.

I claim:

1. A device for cleaning rows of textile machines while travelling along the row of machines, comprised of a blower guided above the machines and having a ventilator housing with an air duct connected to a pressure side of the blower, a flexible hose being attached to the air duct, a distributor station comprising a slider containing a through hole, the flexible hose being attached to the slider to communicate with the through hole, at least two cleaning hoses each being attached to the distributor station via a respective one of a row of air conducting connectors, the two hoses having separate openings directed toward the machines, the slider being movable along the row of connectors; whereby when the slider is moved, its through-hole successively coincides with each of the connectors and air from the air duct is distributed via the flexible hose to one of the two cleaning hoses via a connector with which the through-hole coincides.

2. A device according to claim 1 in which the connectors are arranged in a straight row.

3. A device according to claim 1, in which the connectors are arranged in a curved row.

4. A device according to claim 1, in which the flexible hose is fastened to a further slider with its side facing the pressure side of the blower whereby by operating said slider, the flexible hose can be connected to a suction side of the blower.

5. A device according to claim 1, in which the blower has an impeller whose axis is vertically oriented.

6. A device according to claim 1, further comprising a further distributor station which is essentially identical to the first distributor station but is located on the opposite side of the blower than the first distributor station.

7. A device according to claim 6 further including a second slide corresponding to the first slide but located on the opposite side of the distributor station than the first slider, the first and second sliders each having a handle for manually operating a slider to which it is connected.

8. A device according to claim 6, in which the connectors are arranged in a straight row.

9. A device according to claim 6, in which the connectors are arranged in a curved row.

10. A device according to claim 6 in which said slider is movable into a position in which the through hole does not coincide with any of the connectors.

11. A device according to claim 1 including means for electromotively operating said slider.

12. A device according to claim 1 in which said slider is movable into a position in which the through hole does not coincide with any of the connectors.

* * * * *